US006254298B1

(12) United States Patent
Hsu

(10) Patent No.: US 6,254,298 B1
(45) Date of Patent: Jul. 3, 2001

(54) BALLPOINT PEN STAND DECORATED WITH MOVABLE FUNNY ORNAMENT

(76) Inventor: Ming-Tay Hsu, PO Box 82-144, Taipei (TW)

( * ) Notice: Subject to any disclaimer, the term of this patent is extended or adjusted under 35 U.S.C. 154(b) by 0 days.

(21) Appl. No.: 09/657,599

(22) Filed: Sep. 8, 2000

(51) Int. Cl.[7] ..... B43K 29/00
(52) U.S. Cl. ..... 401/195; 401/243
(58) Field of Search ..... 401/195, 52, 209, 401/243, 222; 446/146, 71, 72, 74, 330, 331

(56) References Cited

U.S. PATENT DOCUMENTS 2,453,646 * 11/1948 Tomlin et al. ..... 446/331
4,561,184 * 12/1985 Fujitani ..... 33/27.02
5,927,881 * 7/1999 Yang ..... 401/52
6,129,473 * 10/2000 Shu ..... 401/195

* cited by examiner

*Primary Examiner*—David J. Walczak
(74) *Attorney, Agent, or Firm*—A & J

(57) ABSTRACT

A ballpoint pen stand decorated with a movable ornament comprises a movable ornament, an ornament seat, a pen barrel, a pen cap, an ink cartridge, and a plurality of lead cords. When the writer takes off the pen cap, presses down the pen barrel, the top lid and the mount will come down too. It therefore shortens the distance between the top lid and the spring collar, the lead cords are loosened, rendering all limbs and joints of the ornament to sag. On the contrary, when the pressure is released, the lead cords are tightened up, the limbs and joints of the ornament recover to position. These successive action produce funny effect while writing with it.

2 Claims, 6 Drawing Sheets

BALLPOINT PEN STAND DECORATED WITH MOVABLE FUNNY ORNAMENT

BACKGROUND OF THE INVENTION

The prior art of ballpoint pen stand achieves the funny effect as usual by means of static sound or light, never presenting in dynamic mood. Nowadays, the such an action effect only takes place on the joint toys such as puppet toy having joints and limb assembled with pivot member and manually manipulated to dispose the toy at the desired position. However, most of them still lack interaction, least interesting at all. In addition the complicated structure of the joint toy renders high production cost.

SUMMARY OF THE INVENTION

A ballpoint pen stand decorated with a movable ornament in accordance with this invention comprises a movable ornament, an ornament base, a pen barrel under the ornament base, a pen cab sleeved on the end of the pen barrel, an ink cartridge placed in the center of the pen barrel, and a plurality of lead cords for controlling the movable ornament. The ornament base is further composed of a top lid, a spring, a spring collar and a mount where the mount holds the top end of the pen barrel, the top lid and the mount are joined together, in between there fills with a spring and a spring collar. The spring collar intimately pushes the top end of the ink cartridge and the spring sits between the top lid and the spring collar. The movable ornament consists of a plurality of limbs and point, inked together by a plurality of lead cords. The lead cords pass downward through the holes of the top lid and around the spring collar and finally to be tightened there. During the writing with such a ballpoint pen, pressing or retracting the lead cords will excite the movable ornament to ascent or descent for fun.

DETAILED DESCRIPTION OF THE INVENTION

The invention will be explained in great detail with the aid of some embodiments of the drawings.

Figure 1:
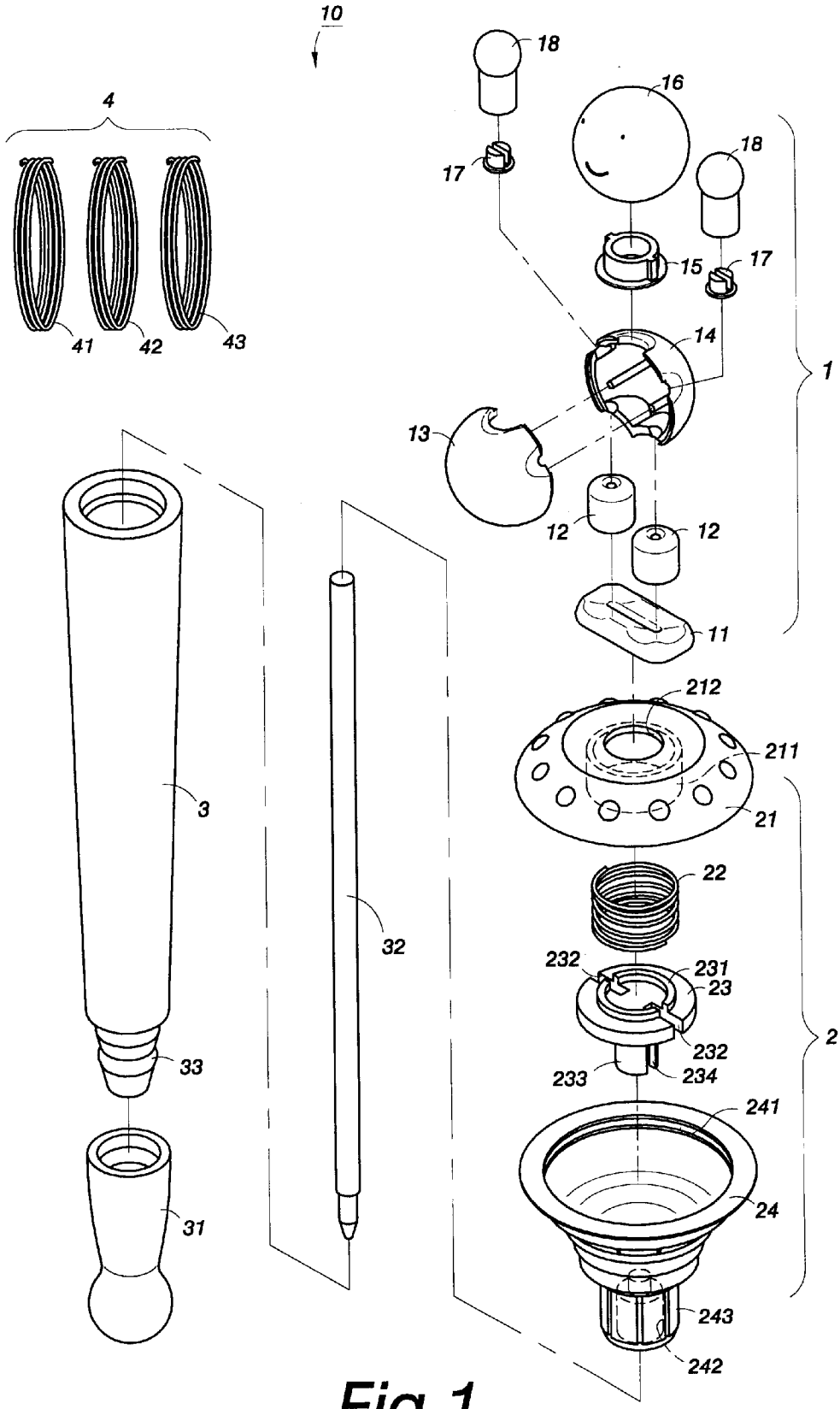
FIG. 1 is the schematic diagram showing the stereo disassembly of the ballpoint pen stand.
Figure 2:
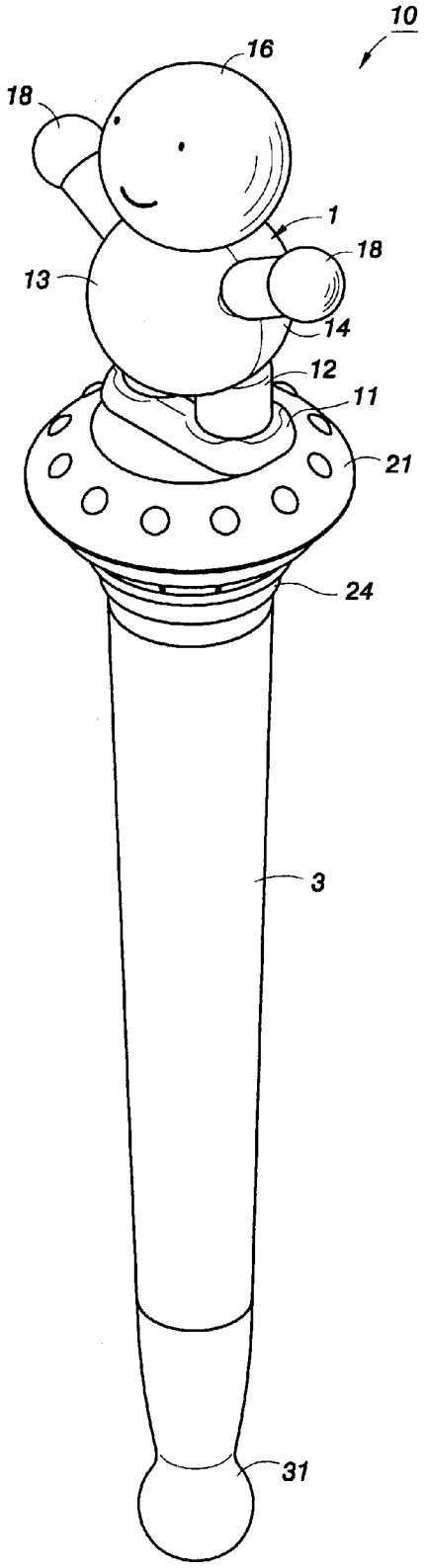
FIG. 2 is the schematic diagram showing the stereo assembly of the ballpoint pen stand.

FIG. 1 shows the stereo disassembly of the funny ballpoint pen stand of the invention, displaying the composition of ballpoint ball stand 10, which constitutes a movable ornament 1, an ornament base 2 beneath the ornament, a pen barrel 3 under the ornament base 2, a pen cap 31 under the pen barrel, an ink cartridge 32 placed in the hollow center of the pen barrel 3, and a plurality of lead cords 4 which are employed to manipulate the movable ornament 1. The complete assembled ball point pen stand is shown in FIG. 2.

Figure 3:
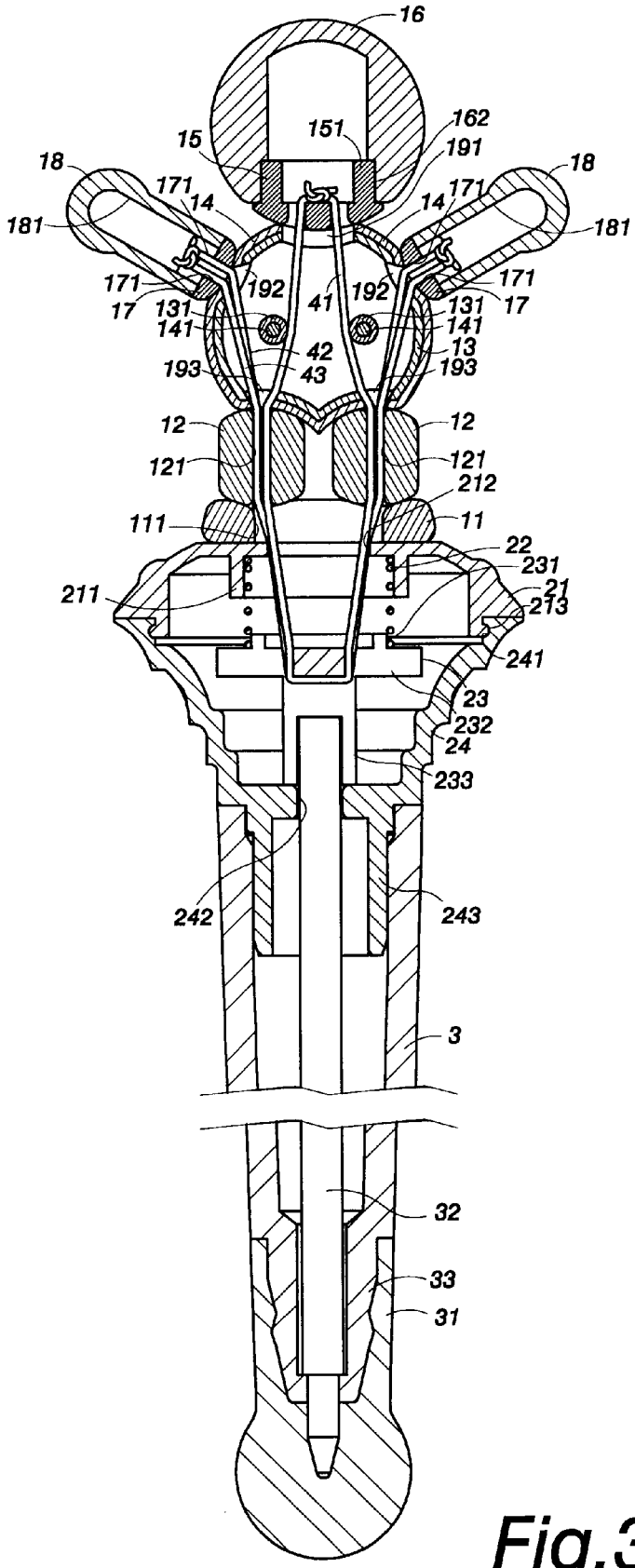
FIG. 3 is the schematic diagram showing the assembly section of the ballpoint pen stand.

FIG. 3 illustrate the assembled section of the ballpoint pen stand of the invention. The ornament base 2 constitutes a to top lid 21, a spring 22, a spring collar 23 and a mount 24. Beneath the top lid 21, there provides a protruded round ring 211 and a go through hole 212. The spring collar 23 has a raised rim 231, two side grooves 232, a projected chute 233 under the bottom and a slot 234 going through two sides of the projected chute 233. The upper end of the spring 22 pierces into the protruded round ring 211 and the lower end perches on the outer edge of the raised rim 231. The top lid 21 has a projected collar 213 on the bottom, and the mount 24 has inward round groove 241. When the top lid 21 is pushed downward onto the mount 24, the projected collar 213 will fix into the inward round groove 241 to provide sufficient space for housing both the spring 22 and the spring collar 23.

The aforesaid mount 24 has a go through aperture 242 and an extended tube 243 which accommodates the upper end of the pen barrel 3. The pen cap 31 installed at the end of the pen barrel 3 fits perfectly with the barrel head 33. The ink cartridge 32 will pass the aperture 242 of the mount 24 and rests in the projected chute 233 of the spring collar 23.

Figure 4:
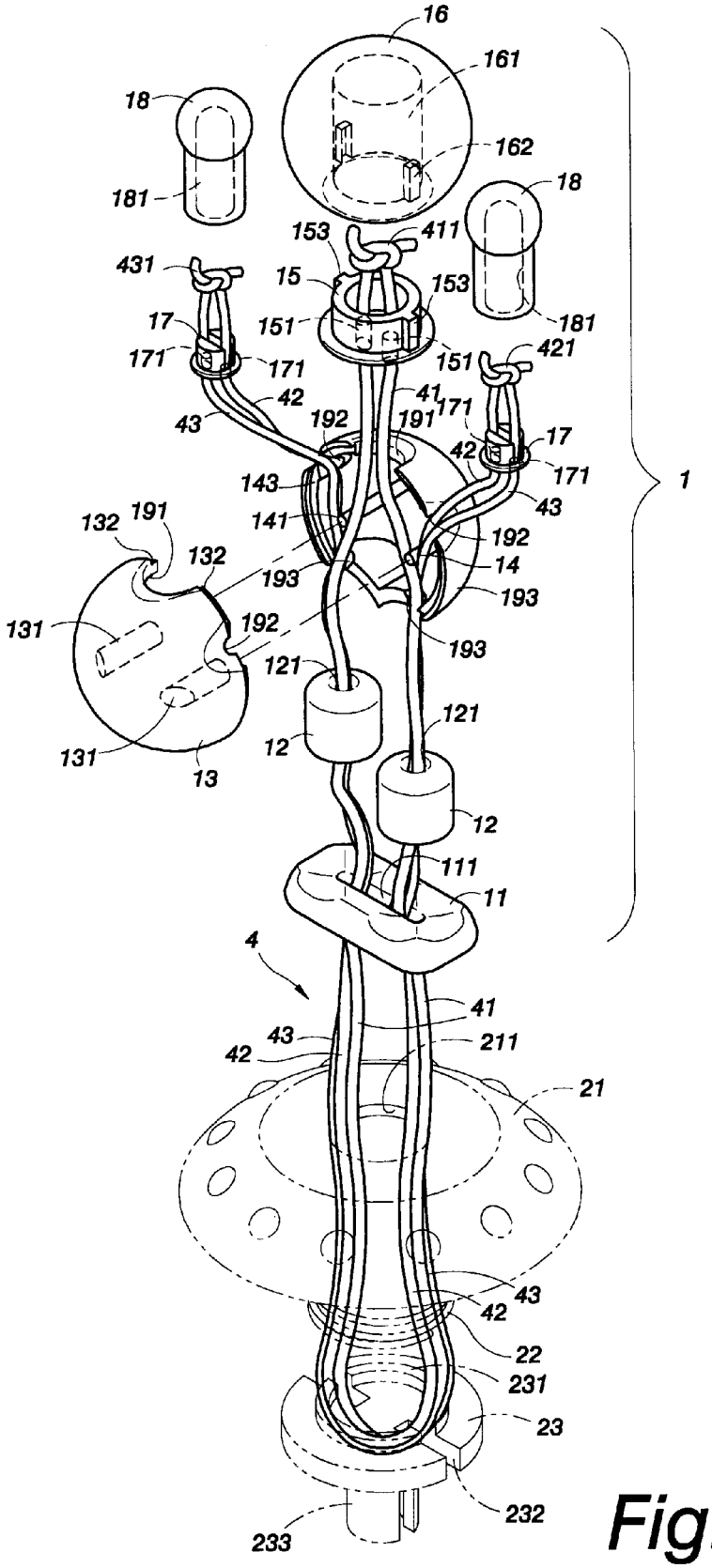
FIG. 4 is the schematic diagram showing the overall assembly of the lead cords and the movable ornament.

Please refer to FIGS. 3 and 4. FIG. 4 illustrates the complete assembly of movable ornament and lead cords and the relationship between the movable ornament 1, a plurality of lead cords 4 and the spring collar 23. Where the movable ornament 1 consists of a base plate 11, two lower limbs 12, a body composed of a front shell 13 and a back shell 14, a neck joint 15, a head 16, two upper limb joints 17, and two upper limbs 18.

The detail structure of the movable ornament is characterized in that: one long slot 111 on the base plate 11, two small holes 121 through two lower limbs 12, respectively. Above the lower limbs 12, there are two lateral lock tubes 131 fastened on the opening of the raised frame 132 in the semi-circle front shell 13. Two lateral lock rods 141 are fastened on the opening of frame groove (not shown) of the semi-circle rear shell 14, so two shells 13 and 14 are fixed symmetrically by inserting the lock rods 141 into the lock tubes 131. On the neck joint 15, there are two rectangular tenons 153 on both sides and two go through holes 151. On the head 16, there provides a hollow cylinder 161 and two rectangular mortises 162 to receive the two tenons 153 the neck joint 15. On each side of shell 13 and 14, two small holes 171 are provided to connect to the two upper limb joints 17 individually. Each upper limb 18 has a hollow cylinder 181 inside. The joints are linked by means of several lead cords 4.

As described above, the lock tube 131 in the front shell 13 receives the insert of the lock rod 141 of the back shell 14, furthermore, the raised frame 132 fits into the frame groove 142 to form a toy body. The body periphery furnishes five guide holes, one neck guide hole 191, two upper limb guide holes 192 and two lower limb guide holes 193. Three lead cords 41 through 43 are used to link them together. The lead cord 41 is a leading cord, starting in the neck joint 15 with a knot 411. Two lead cords 41 pass two guide holes 151, entering successively the neck guide hole 191, the lower limb guide hole 193, the small hole 121 on the lower limbs 12, the guide hole 111 on the base plate 11, the small hole 211 on the top lid 21, the side groove 232 on the spring collar 23, finally turning around bottom projected chute 233 and the slot 234. Finally pulling the lead cord very tightly, the tenons 153 fits in the mortises 162 and so the head 16 is secured steadfastly onto the neck joint 15, the neck joint 15 onto the shells 13 and 14, the shells 13 and 14 onto two lower limbs 12, and two lower limbs 12 on the base plate 11.

Other two lead cords 42 and 43 are auxiliaries. These two lead cords begin in the left and right upper limb joints 17 having individual knot 421 and 431 at each end, running in parallel downward through two small holes 171 on the upper limb joints 17, the upper limb guide hole 192, the lower limb guide hole 193, the small hole 121 on the lower limb 12, the guide hole 111 on the base plate 11, the small hole 211 on the top lid 21, the side groove 232 on the spring collar 23, turning around the slot 234 of the projected chute 233, finally pulling two lead cords 42 and 43 tightly, causing the upper limb joint 17 secured onto the shells 13 and 14, and the upper limb joint 18 on the upper limb 17. The assembly is well done.

Figure 5:
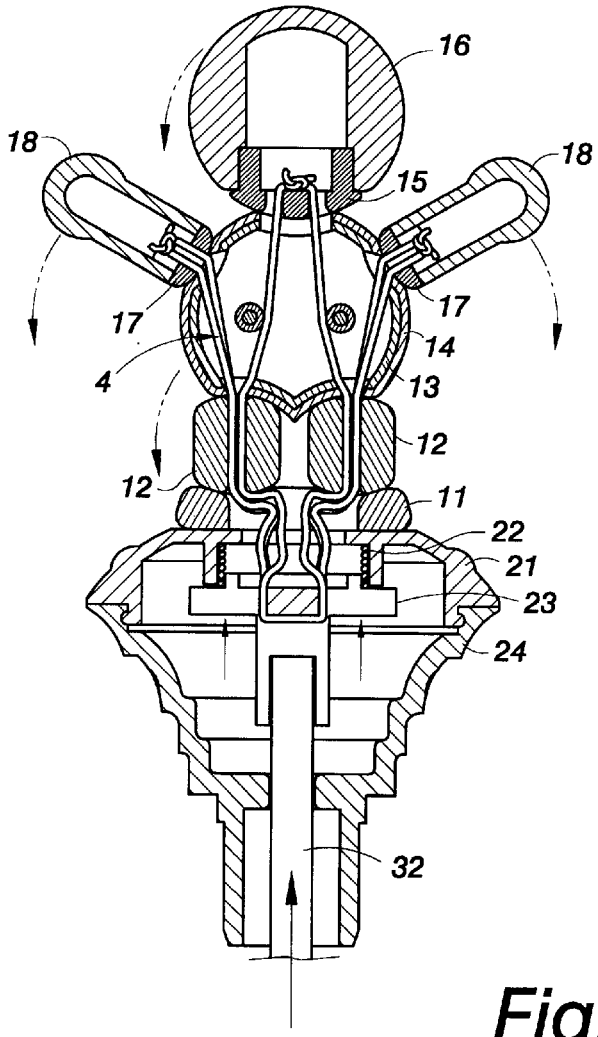
FIG. 5 is the schematic diagram showing the ballpoint pen is under pressing.
Figure 6:
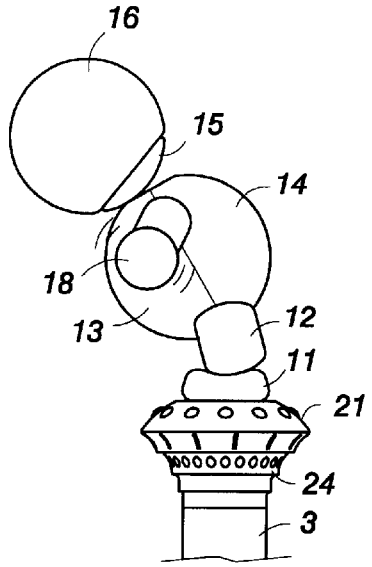
FIG. 6 illustrates the side view of the ballpoint pen stand.

As shown in FIG. 5, the ballpoint pen is under pressing. If the writer wants to use the ballpoint pen 10, he has to take off the pen cap 31, contacts the pen tip of the ink cartridge 32 on the surface of a piece of paper. At this moment, when the ballpoint pen 10 is pressed down and the pressure applied is greater than the resistance of the spring 22, the spring is contracted and slid downward along with the top lid 21, the mount 24, the ornament 1 and the pen barrel 3 (similarly the ink cartridge 32 and the spring collar are uplifting.) Whereas the distance between the spring collar 32 and the top lid 21 is shortened, three lead cords 4 are thereby loosened, both the limbs and joints of the ornament will naturally sag down as shown in FIG. 6.

Figure 7:
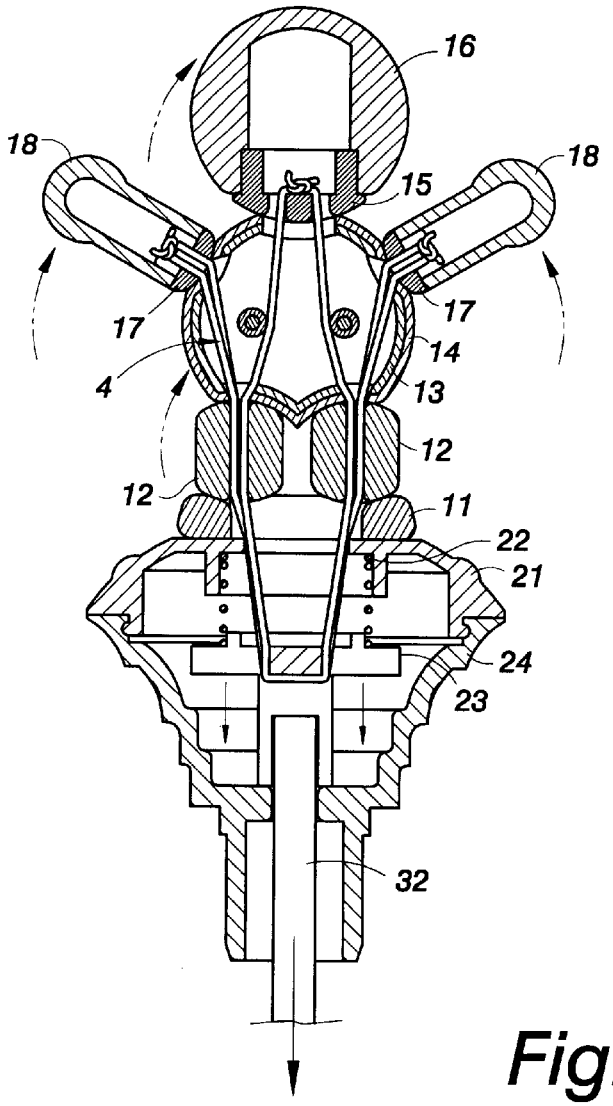
FIG. 7 is the schematic diagram showing the pressure exercised on the ballpoint pen is released.

FIG. 7 illustrates that the pressure applied to the ballpoint pen 10 is released.

Figure 8:
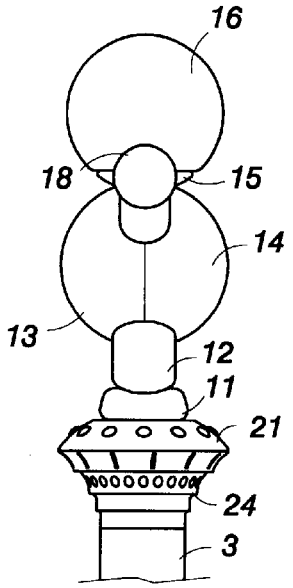
FIG. 8 illustrates the side view of the ballpoint pen stand as shown in FIG. 7.

Once the applied pressure is released, the spring 22 regains the elasticity and pushes the top lid 21 and the mount 24 along with the ornament 1 and the pen barrel 3 up, the lead cords are pulled straightly tight, all components return to the original positions as shown in FIG. 8.

Repeated practice of such an action will make the ornament 1 on the ballpoint pen 10 movable. The ornament specified in the invention is not confined to a single pattern, it can be different animals or toys to make the funny effect changeable. Taking a bird for an example, with wings and face, by mechanical linkage, it produces a flying bird. Such a simple design change will render abundant derivatives. To an artist, such a design change is easy and very simple. The design and application of control cord to stir an action on an ornament belong to the scope of this invention.

The invention has achieved the following remarkable results.

1. The ballpoint pen stand serves as a writing tool and a decoration.
2. The interaction of the lead cord and the ornament will produce a wide variety of actions, such as jumping, swinging and quivering.
3. It requires no battery and circuit control and it presents no environmental nuisance.
4. Simplified structure, low cost and easy to produce for mass production.
5. The interaction of pen and ornament will invite the attention and curiosity from children who will consequently develop greater thinking.

What is claimed is:

1. A ballpoint pen stand decorated with a movable ornament comprising:

a movable ornament;

an ornament base under said movable ornament;

a pen barrel beneath said ornament base;

a pen cap fixed on a lower end of said pen barrel;

an ink cartridge placed in a center of said pen barrel; and a plurality of lead cords for controlling said movable ornament;

wherein said ornament base has a top lid, a spring, a spring collar and a mount, said mount being secured on an upper end of said pen barrel, said top lid and said mount being integrally assembled with a central room to house said spring and said spring collar, said spring being disposed between said top lid and said spring collar, said spring collar having a bottom intimately contacting said ink cartridge, said movable ornament having a plurality of limbs and joints linked together and controlled by said lead cords, said lead cords extending through said top lid and being fastened on said spring collar.

2. The ballpoint pen as claimed in claim 1, wherein said spring collar has raised rim to hold said spring.

* * * * *